US005094082A

United States Patent [19]

Thompson et al.

[11] Patent Number: 5,094,082

[45] Date of Patent: Mar. 10, 1992

[54] STORED ENERGY COMBUSTOR

[75] Inventors: Robert G. Thompson; Colin Rodgers; Nipulkumar Shah; Jack R. Shekleton, all of San Diego, Calif.

[73] Assignee: Sundstrand Corporation, Rockford, Ill.

[21] Appl. No.: 455,570

[22] Filed: Dec. 22, 1989

[51] Int. Cl.[5] ..... F02C 3/00

[52] U.S. Cl. ..... 60/750; 60/755; 431/351; 431/353; 431/9

[58] Field of Search ..... 60/750, 752, 755, 757, 60/760, 753, 756; 431/9, 10, 158, 183, 187, 351, 353

[56] References Cited

U.S. PATENT DOCUMENTS

| | | | |
|---|---|---|---|
| 2,195,025 | 3/1940 | Couzinet . | |
| 2,398,654 | 4/1946 | Lubbock et al. | 60/755 |
| 2,923,348 | 2/1960 | Fraser | 431/158 |
| 3,309,866 | 3/1967 | Kydd . | |
| 3,618,319 | 11/1971 | Kydd . | |
| 3,631,675 | 1/1973 | Keiter et al. . | |
| 3,744,242 | 7/1973 | Stettler et al. . | |
| 3,748,087 | 7/1973 | Shular | 431/351 |
| 3,749,548 | 7/1973 | Zink et al. | 431/158 |
| 3,826,083 | 7/1974 | Brandon et al. . | |
| 3,958,413 | 5/1976 | Cornelius et al. . | |
| 4,050,238 | 9/1977 | Holzapfel . | |
| 4,113,425 | 9/1978 | von Linde et al. . | |
| 4,373,325 | 2/1983 | Shekleton | 60/748 |
| 4,448,354 | 5/1984 | Reznick et al. . | |
| 4,943,230 | 7/1990 | Shekleton | 431/183 |
| 4,955,202 | 9/1990 | Shekleton et al. | 60/760 |

FOREIGN PATENT DOCUMENTS

| | | | |
|---|---|---|---|
| 215003 | 5/1924 | Canada | 60/752 |
| 1225709 | 7/1960 | France | 431/158 |
| 700017 | 11/1953 | United Kingdom | 60/757 |

*Primary Examiner*—Richard A. Bertsch
*Assistant Examiner*—Timothy S. Thorpe
*Attorney, Agent, or Firm*—Wood, Phillips, Mason, Recktenwald & Vansanten

[57] ABSTRACT

In order to provide an expansive central recirculating gas zone (40) in a combustor (10), and in a manner wherein the combustion chamber (20) is of compact volume, a stored energy combustor (10) comprises a vessel (12) having narrow, spaced-apart inlet and outlet ends (14, 16) interconnected by a wall (18) defining a relatively wise combustion chamber (20). The combustion chamber (20) is generally annular and a wall (18) defining the combustion chamber (20) includes an upstream wall region (18*a*) and a downstream wall region (18*c*) interconnected by a generally annular side wall region (18*b*). The inlet end (14) and outlet end (16) are generally tubular extensions of the vessel (12) leading to and from the combustion chamber (20) and oxidant is swirled in the tubular extension (14) leading to the combustion chamber (20) and directed in a swirling annulus into the combustion chamber (20) outwardly of a fuel injector (28). The combustion chamber (20) is formed such that at least the upstream wall region (18*a*) has an inner surface of gentle radius joining the generally annular side wall region (18*b*) to the tubular extension (14) of the vessel (12) leading to the combustion chamber (20). With this arrangement, the swirling oxidant annulus expands radially outwardly in a generally conical fashion within the combustion chamber (20) upon exiting the tubular extension (14) while sticking to at least the upstream wall region (18*a*) of the wall (18) defining the combustion chamber (20).

12 Claims, 1 Drawing Sheet

STORED ENERGY COMBUSTOR

FIELD OF THE INVENTION

The present invention is directed to a stored energy combustor and, more particularly, a stored energy combustor having an expansive central recirculating gas zone.

BACKGROUND OF THE INVENTION

Stored energy combustors have long been utilized for producing hot gases of combustion under pressure to operate turbines. In such stored energy combustors, a carbonaceous fuel is typically combusted with an oxidant to produce hot gases of combustion, and additional fuel may typically be introduced into the hot gases of combustion to be vaporized, or partly decomposed, or both. By so doing, the volume of hot gas can be increased while bringing the temperature of the combustion gas down to a temperature incapable of causing damage to the turbine.

Generally speaking, it has been known that a stored energy combustor may utilize swirling oxidant to generate recirculation zones to provide continuous ignition. Typically, the size of the inner recirculation zone, which is generally known to be critical, is a strong function of swirl blade angle. In this connection, it is known that the size of the generated recirculation zone is increased by an increased swirl blade angle.

In fact, one of the swirler's primary functions is to induce combustion products to flow upstream. There, the combustion products meet and merge with incoming fuel and oxidant. In typical applications, there is little or no recirculation generated where there is weak swirl.

However, when the swirl number is increased to a point where it reaches a critical value, e.g., a swirl number greater than 0.6, the static pressure in the central core just downstream of the swirler becomes low enough to create flow recirculation. Typically, to achieve a strong inner recirculation zone, swirl blade angles are generally in the range of approximately 45° to 60° and, if a significantly smaller angle is utilized, there is weak swirl with little or no inner recirculation.

As is known in accordance with conventional theory, this would ordinarily result in producing unsatisfactory combustion. It is also known that a stored energy combustor should ideally be extremely compact and lightweight, which means that it is essential to generate an expansive inner recirculation zone to provide highly satisfactory continuous ignition and consequent high levels of performance in the combustor. As a result, it would be thought that swirl blade angles on the order of 45° to 60° would be most highly advantageous for this purpose.

However, in actual tests, the inner recirculation zone was found to be too small to avoid significant ignition difficulties. Thus, theory was not borne out in practice when it came to stored energy combustors of compact volume. As a result, it has remained to provide a stored energy combustor having an entirely satisfactory inner recirculation to achieve the objective of continuous ignition.

The present invention is directed to overcoming one or more of the foregoing problems and achieving one or more of the resulting objects.

SUMMARY OF THE INVENTION

It is the principal object of the present invention to provide a new and improved stored energy combustor. More specifically, it is an object of the invention to provide a stored energy combustor of compact volume having a strong inner recirculation zone. It is also an object of the present invention to provide a stored energy combustor with enhanced performance characteristics.

An exemplary embodiment of the invention achieves the foregoing in a stored energy combustor comprising a vessel having an interior wall defining narrow, spaced-apart inlet and outlet ends. The inlet and outlet ends are interconnected by a wall defining a relatively wide combustion chamber, and the vessel has a longitudinal axis extending from the inlet end through the combustion chamber to the outlet end thereof. With this general understanding of the invention, the inlet end and outlet end are generally tubular extensions of the vessel leading to and from the combustion chamber, respectively.

The stored energy combustor includes an oxidant inlet port upstream of the combustion chamber for directing oxidant into the combustion chamber through the tubular extension of the vessel leading to the combustion chamber. The oxidant inlet port is generally concentric with the longitudinal axis of the vessel at the inlet end thereof. Still further, the stored energy combustor includes fuel injection means in the tubular extension of the vessel leading to the combustion chamber for directing fuel into the combustion chamber.

In addition, the stored energy combustor includes means upstream of the combustion chamber and a discharge end of the fuel injection means for swirling the oxidant. The tubular extension of the vessel leading to the combustion chamber is thus adapted to direct oxidant in a swirling annulus into the combustion chamber outwardly of the fuel injection means. With this arrangement, the stored energy combustor includes means for igniting the oxidant and the fuel so as to produce hot gases of combustion.

In accordance with the invention, the combustion chamber is generally annular and the wall defining the combustion chamber includes an upstream wall region and a downstream wall region interconnected by a generally annular side wall region. The entirety of the wall defining the combustion chamber, i.e. the upstream wall region, side wall region, and downstream wall region, are concentric with the longitudinal axis of the vessel. In addition, the wall defining the combustion chamber is formed such that at least the upstream wall region has an inner surface of gentle radius joining the generally annular side wall region to the tubular extension of the vessel leading to the combustion chamber.

Other details of the invention include the fuel injection means comprising a fuel injector including a double-walled hollow tube defining a fuel passageway extending in generally concentric relation to the longitudinal axis of the vessel. The fuel injector is formed such that the fuel passageway terminates in a fuel nozzle for directing a generally conical annulus of fuel into the combustion chamber generally tangentially of the upstream wall region. In addition, the igniting means is disposed generally at a point within the wall defining the combustion chamber where the inner surface of gentle radius of the upstream wall region joins the generally annular side wall region.

With these features, the tubular extension of the vessel leading to the combustion chamber directs oxidant into the combustion chamber outwardly of the generally conical annulus of fuel from the fuel nozzle. In connection with the oxidant, the oxidant swirling means preferably comprises an air swirler including a plurality of vanes for spinning oxidant in the tubular extension of the vessel leading to the combustion chamber to a swirl angle of less than 45°. Still more specifically, the vanes of the air swirler comprising the oxidant swirling means may advantageously spin oxidant in the tubular extension to a swirl angle of less than about 35°.

In a most highly preferred embodiment, the tubular extension of the vessel leading to the combustion chamber is integral with and terminates at the upstream wall region to form a smooth radially expanding juncture at the point of entry into the combustion chamber. The swirling oxidant annulus may therefore expand radially outwardly in a generally conical fashion within the combustion chamber upon exiting the tubular extension of the vessel leading to the combustion chamber such that the generally conical swirling oxidant annulus "sticks" to the wall defining the combustion chamber at least along the upstream wall region thereof. With this arrangement, the generally conical swirling oxidant annulus causes an expansive zone of recirculating gases in the combustion chamber inwardly of the generally conical annulus of fuel to promote excellent continuous ignition characteristics.

Other objects, advantages, and features of the present invention will become apparent from a consideration of the following specification taken in conjunction with the accompanying drawings.

DETAILED DESCRIPTION OF THE PREFERRED EMBODIMENT

Figure 1:
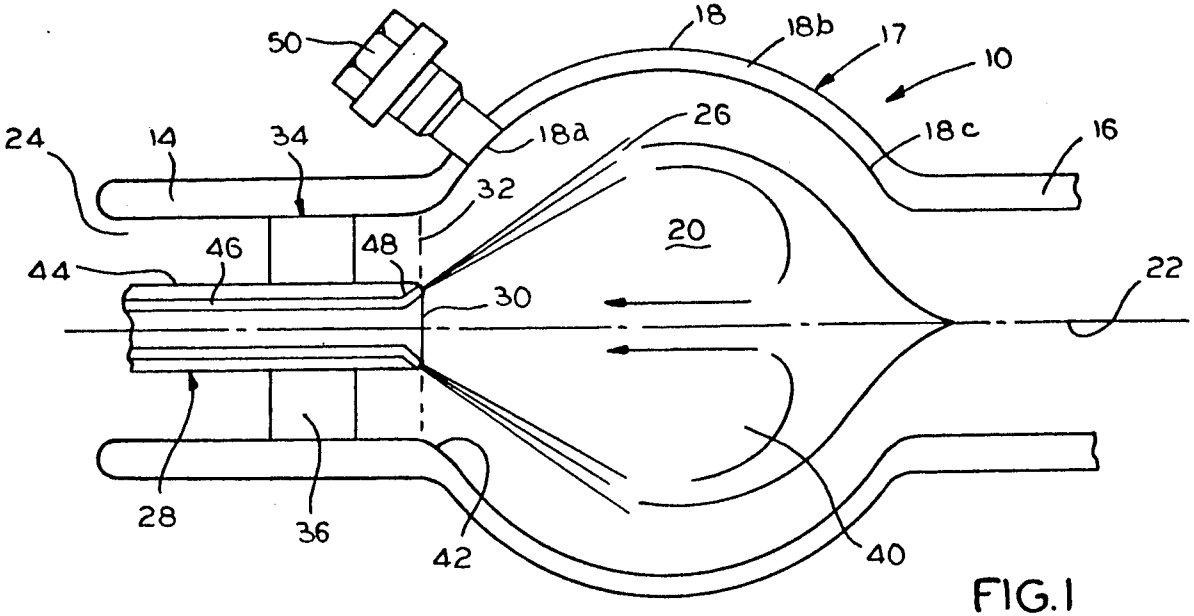
FIG. 1 is a partially schematic, partially sectional view of a stored energy combustor in accordance with the present invention.

In the illustration given, and with reference first to FIG. 1, the reference numeral 10 designates generally a stored energy combustor in accordance with the present invention. The stored energy combustor 10 comprises a vessel 12 having narrow, spaced-apart inlet and outlet ends 14 and 16 interconnected by a wall 18 defining a relatively wide combustion chamber 20 wherein a longitudinal axis 22 extends from the inlet end 14 through the combustion chamber 20 to the outlet end 16 thereof. The combustion chamber 20 is generally annular, and preferably spherical, in shape, with the inlet end 14 and outlet end 16 comprising generally tubular extensions of the vessel 12 leading to and from the combustion chamber 20. The stored energy combustor 10 also comprises an oxidant inlet port 24 upstream of the combustion chamber 20 for directing oxidant into the combustion chamber 20 through the tubular extension 14 and comprises fuel injection means in the tubular extension 14 for directing fuel, preferably in a generally conical annulus as at 26, into the combustion chamber 20. As will be appreciated from FIG. 1, the fuel injection means comprises a fuel injector 28 having a discharge end 30 substantially at a plane at the juncture of the tubular extension 14 and the wall 18 at the point of entry as at 32 into the combustion chamber 20.

Still referring to FIG. 1, the oxidant inlet port 24 and the fuel injector 28 are both concentric with the longitudinal axis 22 of the vessel 12 at the inlet end 14 thereof. It will also be appreciated that the oxidant inlet port 24 is arranged so as to direct oxidant into the combustion chamber 20 in surrounding relation to the fuel injector 28 and outwardly of the generally conical annulus of fuel as at 26. Still additionally, means are provided upstream of the combustion chamber 20 and the discharge end 30 of the fuel injector 28 for swirling the oxidant in the tubular extension 14 of the vessel 12.

Figure 2:
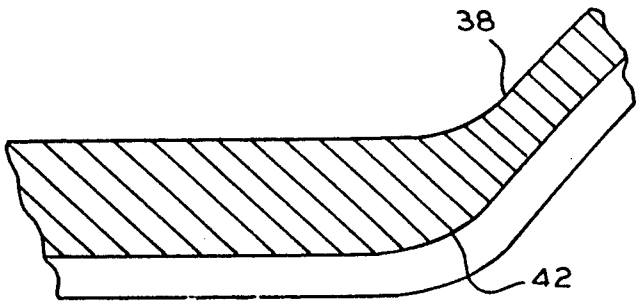
FIG. 2 is an enlarged detail view of a portion of the stored energy combustor of FIG. 1 illustrating an annulus of oxidant "sticking" to a wall of a combustion chamber.

More specifically, the oxidant swirling means comprises an air swirler 34 having a plurality of vanes 36 for spinning oxidant in the tubular extension 14 of the vessel 12 upstream of the combustion chamber 20 to a desired swirl angle of less than 45°, and preferably less than 35°. Thus, the tubular extension 14 is adapted to direct oxidant in a swirling annulus into the combustion chamber 20 outwardly of the generally conical annulus of fuel as at 26 where the swirling oxidant annulus expands radially outwardly as at 38 in a generally conical fashion within the combustion chamber 20 upon exiting the tubular extension 14 of the vessel 12 leading to the combustion chamber 20. As will be appreciated from FIG. 2, the generally conical swirling oxidant annular as at 38 "sticks" to the wall 18 defining the combustion chamber 20 at least along an upstream wall region 18*a* to thereby cause an expansive central zone of recirculating gases as at 40 inwardly of the generally conical annulus of fuel as at 26.

Referring to FIG. 1, the combustion chamber 20 is generally spherical with the wall 18 defining the combustion chamber 20 including a generally spherical side wall region 18*b* interconnecting an upstream wall region 18*a* and a downstream wall region 18*c*. It will be seen that the entirety of the wall 18, i.e., the upstream wall region 18*a*, the side wall region 18*b*, and the downstream wall region 18*c*, are concentric with the longitudinal axis of the vessel 22. In addition, and most importantly, the wall 18 is formed such that at least the upstream wall region 18*a* has an inner surface of gentle radius as at 42 which joins the tubular extension 14 to the generally spherical side wall region 18*b*.

In this connection, the tubular extension 14 is integral with and terminates at the upstream wall region 18*a* to form a smooth radially expanding juncture at the point of entry 32 into the combustion chamber 20. The swirling oxidant annulus is thereby well adapted to expand radially outwardly as at 38 in a generally conical fashion, while sticking to the wall 18 by means of the Coanda phenomenon at least along the upstream wall region 18*a* and at least partially into the generally spherical side wall region 18*b*. In addition to creating the expansive central recirculating gas zone 40 as illustrated in FIG. 1, the generally conical annulus of fuel as at 26 can then be directed between this central zone 40 and the generally conical swirling oxidant annulus as at 38.

As best shown in FIG. 1, the fuel injector 28 preferably comprises a double-walled hollow tube 44 defining a fuel passageway 46 extending in generally concentric relation to the longitudinal axis 22 of the vessel 12. The fuel injector 28 is formed such that the fuel passageway 46 terminates in a conical fuel nozzle 48 for directing the generally conical annulus of fuel as at 26 into the combustion chamber 20 generally in a direction which is tangentially of the upstream wall region 18*a*. With this arrangement, the means for igniting the oxidant and the fuel may comprise an igniter 50 disposed generally at a point within the wall 18 defining the combustion chamber 20 where the inner surface of gentle radius as at 42 of the upstream wall region 18*a* joins the generally annular side wall region 18*b*.

As previously mentioned, the air swirler 34 preferably comprises a plurality of vanes 36 for spinning oxidant to a swirl angle of less than about 45° and preferably less than about 35°. It has also been found advantageous for the generally spherical side wall region 18*b* to have a radius on the order of nine times greater than the inner surface of gentle radius as at 42 of the upstream wall region 18*a*. With these swirl parameters and radii relationships, the unique expansive central recirculating gas zone 40 is achieved.

While in the foregoing there has been set forth a preferred embodiment of the invention, it will be appreciated that the details herein given may be varied by those skilled in the art without departing from the true spirit and scope of the appended claims.

We claim:

1. A stored energy combustor, comprising:

a vessel having narrow, spaced apart inlet and outlet ends interconnected by wall means defining a relatively wide combustion chamber;

said vessel having a longitudinal axis extending from said inlet end through said combustion chamber to said outlet end thereof, said combustion chamber being generally spherical and said wall means defining said combustion chamber including an upstream wall region and a downstream wall region interconnected by a generally spherical side wall region concentric with said longitudinal axis of said vessel, said inlet end and outlet end being generally tubular extensions of said vessel leading to and from said combustion chamber;

an oxidant inlet port upstream of said combustion chamber for directing oxidant into said combustion chamber, said oxidant inlet port being concentric with said longitudinal axis of said vessel at said inlet end;

fuel injection means in said tubular extension of said vessel leading to said combustion chamber, said fuel injection means having a discharge end and directing a generally conical annulus of fuel into said combustion chamber from said discharge end thereof at a point of entry into said combustion chamber generally tangentially of said upstream wall region of said wall means defining said combustion chamber, said fuel injection means being concentric with said longitudinal axis of said vessel;

said oxidant inlet port directing oxidant into said combustion chamber through said tubular extension of said vessel leading to said combustion chamber in surrounding relation to said fuel injection means;

means upstream of said combustion chamber and said discharge end of said fuel injection means for swirling said oxidant in said tubular extension of said vessel leading to said combustion chamber, said tubular extension of said vessel leading to said combustion chamber directing oxidant in a swirling annulus into said combustion chamber outwardly of said generally conical annulus of fuel;

said wall means defining said combustion chamber being formed such that at least said upstream wall region has an inner surface of gentle radius joining said generally spherical side wall region to said tubular extension of said vessel leading to said combustion chamber, said tubular extension of said vessel leading to said combustion chamber being integral with and terminating at said upstream wall region to form a smooth radially expanding juncture comprising said inner surface of gentle radius at said point of entry into said combustion chamber, said wall means defining said combustion chamber thereby being formed such that said inner surface of gentle radius is sufficient to cause said swirling oxidant annulus to stick to said wall means at least along said upstream wall region thereof; and means for igniting said oxidant and said fuel to produce hot gases of combustion.

2. The stored energy combustor of claim 1 wherein said fuel injection means comprises a fuel injector including a double-walled hollow tube defining a fuel passageway extending in generally concentric relation to said longitudinal axis of said vessel.

3. The stored energy combustor of claim 2 wherein said fuel injector is formed such that said fuel passageway terminates at said discharge end in fuel nozzle means for directing said generally conical annulus of fuel into said combustion chamber generally tangentially of said upstream wall region.

4. The stored energy combustor of claim 1 wherein said igniting means is disposed generally at a point within said wall defining said combustion chamber where said inner surface of gentle radius of said upstream wall region joins said generally annular side wall region.

5. The stored energy combustor of claim 1 wherein said oxidant swirling means comprises an air swirler including a plurality of vanes for spinning oxidant in said tubular extension of said vessel leading to said combustion chamber to a swirl angle of less than 45 degrees.

6. A stored energy combustor, comprising:

a vessel having narrow, spaced apart inlet and outlet ends interconnected by wall means defining a relatively wide combustion chamber;

said vessel having a longitudinal axis extending from said inlet end through said combustion chamber to said outlet end thereof, said combustion chamber being generally spherical and said wall means defining said combustion chamber including an upstream wall region and a downstream wall region interconnected by a generally spherical side wall region concentric with said longitudinal axis of said vessel, said inlet end and outlet end being generally tubular extensions of said vessel leading to and from said combustion chamber;

an oxidant inlet port upstream of said combustion chamber for directing oxidant into said combustion chamber, said oxidant inlet port being concentric with said longitudinal axis of said vessel at said inlet end;

fuel injection means in said tubular extension of said vessel leading to said combustion chamber, said fuel injection means having a discharge end and directing a generally conical annulus of fuel into said combustion chamber from said discharge end thereof at a point of entry into said combustion chamber generally tangentially of said upstream wall region of said wall means defining said combustion chamber, said fuel injection means being concentric with said longitudinal axis of said vessel;

said oxidant inlet port directing oxidant into said combustion chamber through said tubular extension of said vessel leading to said combustion chamber in surrounding relation to said fuel injection means;

means upstream of said combustion chamber and said discharge end of said fuel injection means for swirling said oxidant in said tubular extension of said vessel leading to said combustion chamber, said tubular extension of said vessel leading to said combustion chamber directing oxidant in a swirling annulus into said combustion chamber outwardly of said generally conical annulus of fuel;

said wall means defining said combustion chamber being formed such that at least said upstream wall region has an inner surface of gentle radius joining said generally spherical side wall region to said tubular extension of said vessel leading to said combustion chamber, said tubular extension of said vessel leading to said combustion chamber being integral with and terminating at said upstream wall region to form a smooth radially expanding juncture comprising said inner surface of gentle radius at said point of entry into said combustion chamber, said wall means defining said combustion chamber thereby being formed such that said inner surface of gentle radius is sufficient to cause said swirling oxidant annulus to stick to said wall means at least along said upstream wall region thereof; and means for igniting said oxidant and said fuel to produce hot gases of combustion;

said wall means causing said swirling oxidant annulus to expand radially outwardly in a generally conical fashion within said combustion chamber upon exiting said tubular extension of said vessel leading to said combustion chamber, said wall means also causing said generally conical swirling oxidant annulus thereto at least along said upstream wall region, said wall means further causing said generally conical swirling oxidant annulus to form an expansive central zone of recirculating gases in said combustion chamber inwardly of said generally conical annulus of fuel;

said fuel injection means directing said generally conical annulus of fuel between said central zone of recirculating gases and said generally conical swirling oxidant annulus.

7. The stored energy combustor of claim 6 wherein said fuel injection means comprises a fuel injector including a double-walled hollow tube defining a fuel passageway extending in generally concentric relation to said longitudinal axis of said vessel.

8. The stored energy combustor of claim 7 wherein said fuel injector is formed such that said fuel passageway terminates at said discharge end in fuel nozzle means for directing said generally conical annulus of fuel into said combustion chamber generally tangentially of said upstream wall region.

9. The stored energy combustor of claim 6 wherein said igniting means is disposed generally at a point within said wall means defining said combustion chamber where said inner surface of gentle radius of said upstream wall region joins said generally annular side wall region.

10. The stored energy combustor of claim 6 wherein said oxidant swirling means comprises an air swirler including a plurality of vanes for spinning oxidant in said tubular extension of said vessel leading to said combustion chamber to a swirl angle of less than about 45 degrees.

11. The stored energy combustor of claim 10 wherein said oxidant swirling means comprises an air swirler including a plurality of vanes spinning oxidant in said tubular extension of said vessel leading to said combustion chamber to a swirl angle of less than about 35 degrees.

12. The stored energy combustor of claim 6 wherein said generally spherical side wall region has a radius on the order of nine times greater than said gentle radius of said inner surface of said upstream wall region of said wall means defining said combustion chamber.

* * * * *